US008037555B2

(12) United States Patent
Fowkes

(10) Patent No.: US 8,037,555 B2
(45) Date of Patent: Oct. 18, 2011

(54) BATHTUB CUSHION WITH ELASTOMERIC GEL AND METHOD OF USING SAME

(76) Inventor: Doug Fowkes, Provo, UT (US)

( * ) Notice: Subject to any disclaimer, the term of this patent is extended or adjusted under 35 U.S.C. 154(b) by 0 days.

(21) Appl. No.: 12/688,359

(22) Filed: Jan. 15, 2010

(65) Prior Publication Data

US 2010/0115692 A1 May 13, 2010

Related U.S. Application Data

(63) Continuation of application No. 11/223,776, filed on Sep. 8, 2005, now Pat. No. 7,665,159.

(51) Int. Cl.
*A47K 3/02* (2006.01)

(52) U.S. Cl. ..... 4/581

(58) Field of Classification Search ..... 4/579–583, 4/578.1

See application file for complete search history.

(56) References Cited

U.S. PATENT DOCUMENTS

| | | | | |
|---|---|---|---|---|
| 2,541,029 | A | 2/1951 | Burton | |
| 2,582,439 | A | 1/1952 | Kavanagh | |
| 2,751,609 | A * | 6/1956 | Oesterling et al. | 5/420 |
| 4,037,591 | A | 7/1977 | Sarno | |
| 4,512,044 | A * | 4/1985 | Clark | 4/581 |
| 4,630,323 | A | 12/1986 | Sage et al. | |
| D290,916 | S | 7/1987 | Madison et al. | |
| 4,819,287 | A * | 4/1989 | Halverson | 5/710 |
| D325,842 | S | 5/1992 | Bied | |
| D335,036 | S | 4/1993 | Simmons | |
| D365,956 | S | 1/1996 | Bonaddio et al. | |
| 5,535,458 | A | 7/1996 | Siverly | |
| D374,367 | S | 10/1996 | Bonaddio et al. | |
| D390,401 | S | 2/1998 | Pirraglia et al. | |
| D390,402 | S | 2/1998 | Pirraglia et al. | |
| D390,403 | S | 2/1998 | Pirraglia et al. | |
| D391,434 | S | 3/1998 | Denney et al. | |
| 5,749,111 | A | 5/1998 | Pearce | |
| D417,354 | S | 12/1999 | Valenti | |
| 6,026,527 | A | 2/2000 | Pearce | |
| 6,068,332 | A | 5/2000 | Faust et al. | |
| D429,437 | S | 8/2000 | Valenti | |
| D429,590 | S | 8/2000 | Wallace | |
| D435,186 | S | 12/2000 | Fulkerson | |
| D444,550 | S | 7/2001 | Cobbs | |
| 6,357,061 | B1 | 3/2002 | Gonzalez | |
| 6,387,013 | B1 | 5/2002 | Marquez | |
| D458,502 | S | 6/2002 | Caban | |
| 6,413,458 | B1 | 7/2002 | Pearce | |
| D469,815 | S | 2/2003 | Wells et al. | |
| D478,452 | S | 8/2003 | Kafka et al. | |

(Continued)

OTHER PUBLICATIONS

Fowkes, U.S. Appl. No. 12/834,550, filed Jul. 12, 2010.

(Continued)

*Primary Examiner* — Huyen Le
(74) *Attorney, Agent, or Firm* — Thorpe North & Western LLP

(57) ABSTRACT

A bathtub cushion has a mat sized and shaped to fit on a bottom of a bathtub. A cushion is coupled to and constrained by the mat. The cushion further comprises a plurality of separate and distinct cushions. The mat circumscribes the plurality of separate and distinct cushions. At least one attachment device is coupled to the mat to retain the mat on the bottom of the bathtub. The mat and the cushion include at least one aperture extending therethrough.

14 Claims, 3 Drawing Sheets

U.S. PATENT DOCUMENTS

| | | | |
|---|---|---|---|
| 6,663,537 | B2 | 12/2003 | McCoy |
| 6,681,416 | B1 | 1/2004 | Yang |
| D486,343 | S | 2/2004 | Feuer |
| D494,402 | S | 8/2004 | Scansetti |
| 7,024,714 | B1 | 4/2006 | Yates |
| 7,060,213 | B2 | 6/2006 | Pearce |
| D528,340 | S | 9/2006 | Contreras |
| D543,405 | S | 5/2007 | Fowkes |
| 7,661,164 | B2 | 2/2010 | Chen |
| 7,665,159 | B2 | 2/2010 | Fowkes |
| 2003/0131407 | A1 | 7/2003 | Gutierrez et al. |

OTHER PUBLICATIONS

Fowkes, U.S. Appl. No. 29/366,265, filed Jul. 22, 2010.
Fowkes, U.S. Appl. No. 12/709,922, filed Feb. 22, 2010.

* cited by examiner

BATHTUB CUSHION WITH ELASTOMERIC GEL AND METHOD OF USING SAME

PRIORITY CLAIM

This is a continuation of U.S. patent application Ser. No. 11/223,776, filed on Sep. 8, 2005 now U.S. Pat. No. 7,665, 159, which is hereby incorporated herein by reference in its entirety.

BACKGROUND

1. Field of the Invention

The present invention relates generally to a bathtub cushion, namely a cushion having an elastomeric gel that can be laid in a bathtub.

2. Related Art

Soaking in a hot bath is both relaxing and therapeutic, and has long been a sought after luxury and creature comfort. However, bathtubs are made of hard, water resistant materials such as ceramic, cast iron, or acrylic composites, which provide rigid, inflexible surfaces that are uncomfortable to lie on for extended periods of time. Bath mats and tub liners have been developed to provide a more comfortable surface for extended use.

Bath mats are often relatively thin, and usually cover only the bottom surface of the bathtub. Bath mats typically are used to provide a non skid surface on the bottom of the tub, but some have been developed to provide a more cushioned surface to a tub occupant. Most mats, however, do not provide cushioning against side surfaces of the tub.

Tub liners have been developed to provide a cushioned surface for a tub occupant. Tub liners have usually been made of foam or an inflatable bladder. These types of cushions have been problematic in bath tubs because they float and are difficult to secure on the bottom of the tub underneath an occupant. They also retain water making them difficult to manipulate and clean after use.

Additionally, lying on a mat or liner for an extended period of time can cause discomfort due to limitations in the flexibility and compressibility of the mat or liner. Such discomfort is often located in peak pressure points such as joints or major muscle groups as a result of edema.

SUMMARY OF THE INVENTION

It has been recognized that it would be advantageous to develop a bathtub cushion that equalizes the pressure across the contact area of the bathtub occupant being cushioned. It would further be advantageous for the cushioning element to conform to the shape of the bathtub occupant while evenly distributing a supporting force across the contact area of the cushioned object and avoiding pressure peaks.

The invention provides a bathtub cushion with a mat sized and shaped to fit on a bottom of a bathtub. A cushion is coupled to and constrained by the mat. The cushion further comprises a plurality of separate and distinct cushions. The mat circumscribes the plurality of separate and distinct cushions. At least one attachment device is coupled to the mat to retain the mat on the bottom of the bathtub. The mat and the cushion include at least one aperture extending therethrough.

Additional features and advantages of the invention will be apparent from the detailed description which follows, taken in conjunction with the accompanying drawings, which together illustrate, by way of example, features of the invention.

DETAILED DESCRIPTION OF EXAMPLE EMBODIMENT(S)

Figure 1:
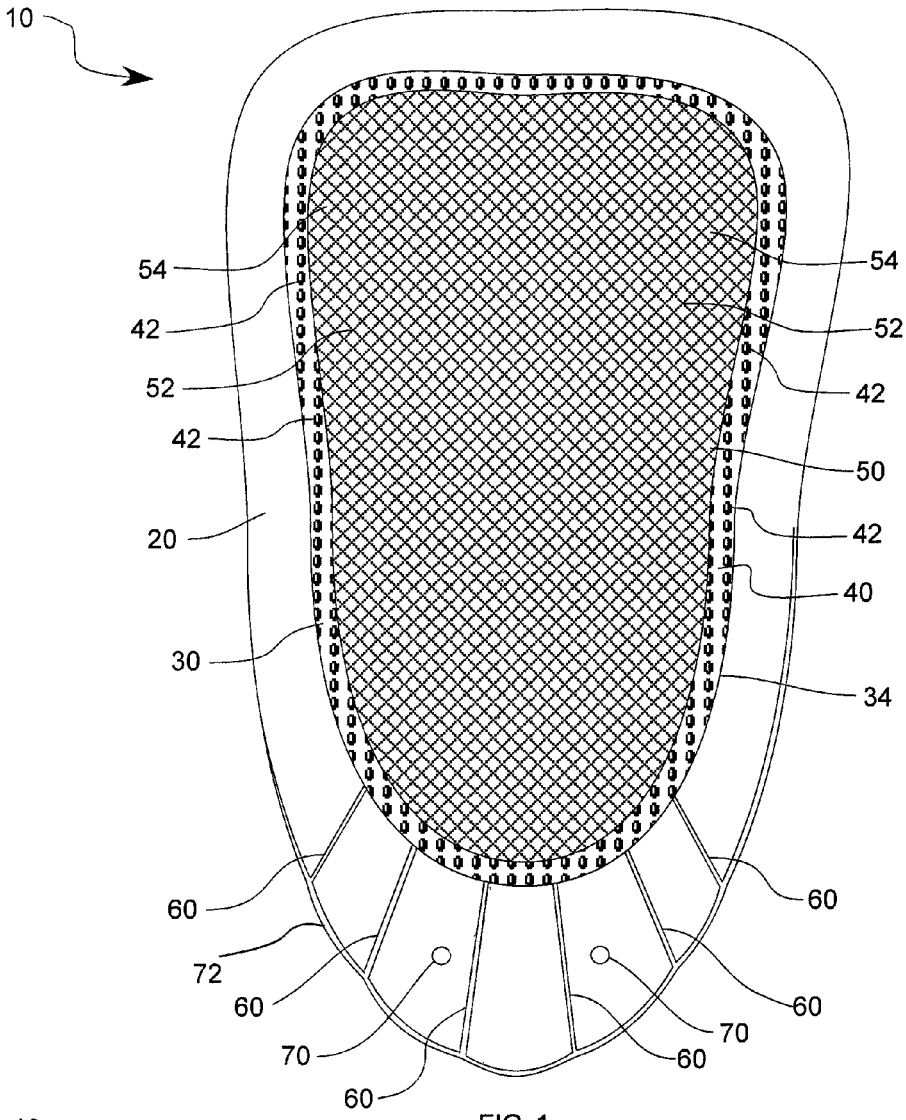
FIG. 1 is a top view of bathtub cushion in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides a bathtub cushion shaped generally to fit on the bottom and along a portion of the sides of a bathtub to cushion the bathtub occupant from the hard and inflexible surfaces of the bathtub. The bathtub cushion can include elastomeric gel cushions configured to support a bathtub occupant, and which are constrained by a foam mat. The foam mat can support and contain the gel cushions along a peripheral edge. The foam mat can have recesses located in the foam mat corresponding to the torso, shoulders, and head of the bathtub occupant. A perforated scrim can be attached to the foam mat and extend across the recesses. The gel cushions can be attached to the scrim and generally fill the recesses so that when an occupant is resting in the bathtub on the bathtub cushion, portions of the gel cushions support the occupant. The gel cushions can have a matrix of intersecting buckling columns that equalize the pressure across the contact area of the occupant being cushioned. The gel cushions conform to the shape of the pressure points of the occupant while evenly distributing a supporting force across the contact area of the cushioned occupant and avoiding pressure peaks. The matrix of buckling columns defines open ended cells between the buckling columns that are open on at least one side. The cells can be open on more than one side to allow water to flow through the gel cushion and perforated scrim.

Figure 2:
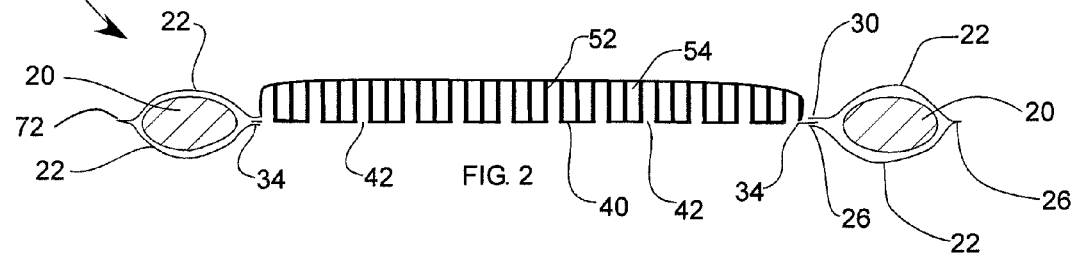
FIG. 2 is a schematic cross section view of the bathtub cushion of FIG. 1.

As illustrated in FIGS. 1 and 2, a bathtub cushion, indicated generally at 10, is shown in accordance with an embodiment of the present invention for use in a bath, and includes an elastomeric gel cushion 50 with a matrix of intersecting buckling columns 52 defining open ended cells 54 between the columns. Specifically, FIG. 1 is a top view of the bathtub cushion and FIG. 2 is a cross sectional schematic view of the bathtub cushion of the present invention.

The bathtub cushion 10 can have a foam mat 20 with a recess 30. The elastomeric gel cushion 50 can be disposed in the recess 30 and constrained by the foam mat 20. The recess 30 can be positioned within an interior of the foam mat 20 so that the foam mat 20 circumscribes substantially all or at least a portion of the recess 30, and thus the gel cushion 50. The recess 30 can extend from an upper surface of the foam mat 20 and downward into the foam mat. The recess 30 can form a hole or aperture that extends all the way through the foam mat recess 30, as shown in FIG. 2. Alternatively, the recess can extend approximately half way into the mat, as described below. The cushion 10, foam mat 20, and/or recess 30 can have any appropriate shape. In one aspect, the cushion 10, foam mat 20, and/or recess 30 is sized to extend longitudinally from the buttocks to the shoulders or head of a typical user, or at least approximately 3 feet, and is sized to extend laterally across the shoulders of the typical user, or at least approximately 1 and ½ feet.

The foam mat 20 can be sealed to restrict moisture from contacting or wetting the foam. For example, the foam can be a closed cell waterproof foam, such as a crosslinked polyethylene foam, or the foam can be sprayed with a water sealing compound such as a polyurethane sealant.

The foam mat 20 can also be sealed in a water resistant liner 22, to create a moisture barrier around the foam, and to restrict moisture from contacting the foam. The water resistant liner 22 can be impermeable to water. For example, the water resistant liner can be plastic sheet, or a terrycloth sheet with a polyurethane backing. It will be appreciated that a terry cloth sheet with a polyurethane backing can be attached to the foam so that the polyurethane backing is directly adjacent the foam mat, while the softer terry cloth sheet is exposed, thereby providing a soft, fuzzy surface that may contact the user's skin.

The water resistant liner 22 can surround the foam mat 20, such as between two sheets. The water resistant liner 22 can be sealed around the foam mat 20 by any sealing process known in the art, such as thermowelding or RF welding. Restricting fluid flow to the foam prevents the foam from acting like a sponge and soaking up water from a full bathtub. It will be appreciated that dry foam weighs less and is easier to move than wet or water soaked foam. In addition, it will be appreciated that dry foam resists mold.

A scrim 40 can be coupled to the foam mat 20 and can extend across the recess 30. The gel cushion 50 can be attached to the scrim 40 and can also extend across the recess 30. Thus, the scrim 40 can form a backing material for the gel cushion 50, and can couple the gel cushion to the foam mat 20. For example, the scrim 40 can be attached to the water resistant liner 22 around the perimeter 34 of the recess 30. For example, the scrim 40 can be attached to the water resistant liner 22 by being sewn to the sealed portion 26 of the water resistant liner 22, or welded into the water resistant liner 22 during the sealing process described above. It will be appreciated that other methods of attaching the scrim 40 to the water resistant liner 22 can be used, such as using adhesives or localized fasteners.

The scrim 40 can be porous and can have a plurality of holes 42 through the scrim to allow fluid flow through the scrim. The holes 42 can be relatively large and formed by cutting or stamping, or the holes can be relatively small and formed by the porous nature of the material. Thus, the scrim can extend across the recess and can be perforated with holes so that water can freely flow through the scrim 40 at the recess 30. The scrim 40 can be a soft pliable fabric material, such as cotton or polyester.

The gel cushion 50 can be coupled to the scrim 40 by being formed or molded directly onto or around the scrim. In addition, the gel cushion 50 can be coupled to the scrim 40 by heat welding, such that the gel cushion 50 is heated and melts into the scrim. The gel cushion can have a matrix of intersecting buckling columns 52 defining open ended cells 54 between the columns. Thus, the cells 54 can have an open upper end. In addition, the scrim 40 can extend across a bottom of the cells 54, with the porous nature of the scrim 40 of the holes formed in the scrim allowing water to pass through the cells. The gel cushions 50 can be made of an elastomeric material or a visco-elastomeric material as described in U.S. Pat. No. 5,749,111 to Pearce and U.S. Pat. No. 6,026,527 to Pearce, which are incorporated by reference in their entirety herein. The gel cushion 50 can have a density approximately the same as the density of water, so that when the bathtub cushion 10 is placed in a tub filled with water the gel cushion 50 will resist floating.

The gel cushion 50 can substantially fill the recess 30 so that when an occupant is resting in the bathtub on the bathtub cushion 10 portions of the gel cushion supports the occupant. The matrix of intersecting buckling columns 52 can equalize the pressure across the contact area of the occupant being cushioned. The gel cushion 50 conforms to the shape of the pressure points of the occupant while evenly distributing a supporting force across the contact area of the cushioned occupant and avoiding pressure peaks. The open ended cells 54 between the buckling columns 52 can be open on at least one side. The cells 54 can also be open on opposing ends thus forming holes through the gel cushion 50 to allow water to flow through the gel cushion 50 and the perforated scrim 40.

It will be appreciated that, in use, the gel cushion 50 is the main support surface of the bathtub occupant, and the foam mat 20 acts mainly to support the gel cushion 30. The foam mat 20 can be configured to be aesthetically pleasing.

The recess 30 can extend through the foam mat 20, and can define a hole through the foam mat 20, as shown in FIG. 2. Thus, water can flow through the cells 54, through the scrim 40, and thus through the hole formed by the recess in the foam mat 20. Fluid flow through the mat 20 aids in removing and placing the mat 20 in a bathtub. As water fills or drains the tub, the water can freely flow through the hole and allow the bathtub cushion 10 to be easily positioned on the bottom of the tub. Similarly, if the tub is full of water when the mat is placed into the tub, the hole allows the water to flow through the bathtub cushion 10 so the bathtub cushion can easily be submerged in the tub and positioned on the bottom of the tub.

As shown in FIG. 2, the cushion 10 or foam mat 20 can be configured or manufactured so that the water resistant liner 22 seal in the middle, thus positioning the scrim 40 in the middle of the recess 30, when the cushion or mat is in a relaxed state as shown. It will be appreciated that in use, and disposed in a bathtub with a user and water disposed thereon, the scrim 40 can be disposed on the surface of the bathtub, while the foam mat 20 extending around the scrim 40 and gel cushion 50 can displace upwardly about the seal 26 positioned between the foam mat 20 and the scrim 40 or recess 30. In one aspect, the gel cushion 50 can have a height at least as high as the foam mat 20 so that the gel cushion 50 acts as the primary support or cushion for the user. In another aspect the gel cushion 50 can extend above the foam mat 20 to further act as the primary support or cushion. a1

The bathtub cushion 10 can also have attachment devices 70, such as suction cups, magnets or weights, mounted to the water resistant liner 22 to help retain the bathtub cushion on the bottom or sides of the bathtub. A plurality of attachment devices 70 can be used to retain the bathtub cushion on the bottom of the bathtub. For example three suction cups could secure the bathtub cushion below the recess to the bottom of the bathtub, and a pair of suction cups could secure each side of the bathtub cushion to the sides or bottom of the bathtub. It will be appreciated that any number of attachment devices 70 can be used to retain the bathtub cushion 10 on the bottom or around the sides of the bathtub.

Figure 3:
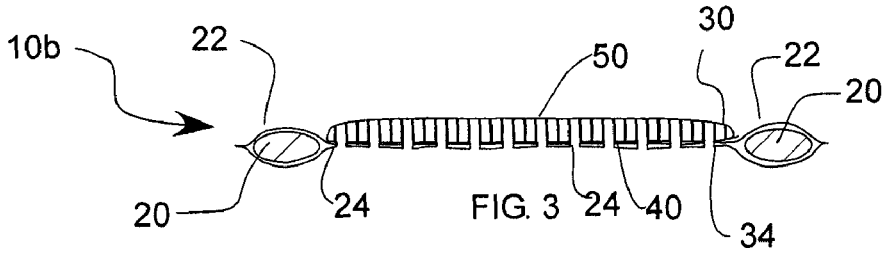
FIG. 3 is a schematic cross section view of a bathtub cushion in accordance with another embodiment of the present invention.

Referring to FIG. 3, a bathtub cushion 10*b* in accordance with another embodiment of the present invention is shown. Specifically, one or both of the water resistant liner 22 are shown extending across the recess 30. In this case, the water resistant liner 22 can be perforated with holes 24 that allow fluid to flow through the water resistant liner. It will be appreciated that the water resistant liner 22 are not porous like the scrim 40. Rather the water resistant liner 22 can be impermeable to water such that water can only flow through the water resistant liner 22 where a hole through the water resistant liner 22 is located. The scrim 40 can be attached to the water resistant liner 22 at the periphery 34 of the recess 30 or across the entire area of the water resistant liner 22. The holes 24 in the water resistant liner 22 can be positioned across the recess 30 to correspond to the cells 54, or can be disposed near a lower longitudinal position in the recess to allow water to drain from the recess. Having the water resistant liner 22 extend across the recess 30 can further strengthen the cushion 10*b*, and can facilitate manufacture.

Figure 4:
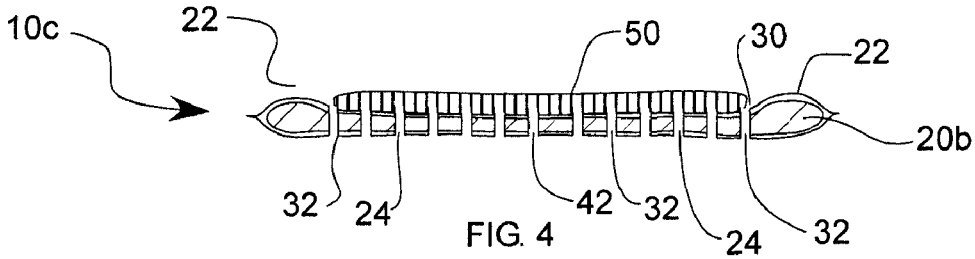
FIG. 4 is a schematic cross section view of a bathtub cushion in accordance with another embodiment of the present invention.

Referring to FIG. 4, a bathtub cushion 10*c* in accordance with another embodiment of the present invention is shown. Specifically, the recess 30 of the bathtub cushion 10 can be a depression in the foam mat that extends from an upper surface to a midpoint in the foam mat. In the case where the recess 30 is a depression in the foam mat, the recess 30 can have a plurality of holes 32 through the foam mat to allow fluid flow through the foam mat. Thus, the foam mat 20*b* can have holes positioned at the recess 30, and the scrim 40 can be perforated with holes 42, so that water in the tub can freely flow through the bathtub cushion 10. Again, the holes 42 in the foam mat 20 can be positioned across the recess 30 to correspond to the cells 54, or can be disposed near a lower longitudinal position in the recess to allow water to drain from the recess.

Figure 5:
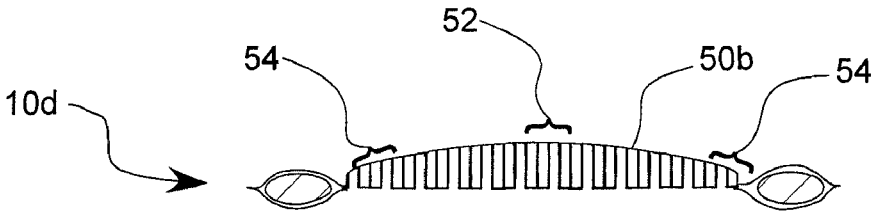
FIG. 5 is a schematic cross section view of a bathtub cushion in accordance with another embodiment of the present invention.

Referring to FIG. 5, a bathtub cushion 10*d* in accordance with another embodiment of the present invention is shown. Specifically, the gel cushion 50*b* is shown with a relatively thicker portion 52 in a middle section. The gel cushion 50*b* can taper to a relatively thinner portion along a periphery 54. Raised or thicker portions can correspond to pressure points of the user to provide additional cushioning.

Figure 6:
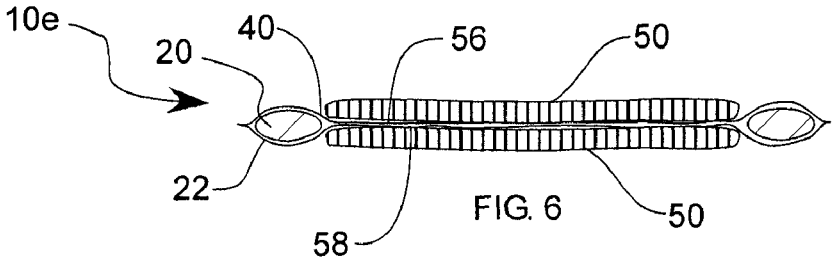
FIG. 6 is a schematic cross section view of a bathtub cushion in accordance with another embodiment of the present invention.

Referring to FIG. 6, a bathtub cushion 10*e* in accordance with another embodiment of the present invention is shown. Specifically, the gel cushion can extend outwardly from two opposing sides 56 and 58 of the scrim 40. This allows the gel cushion 50 to be twice as thick, thereby providing the advantage of softer cushioning to the bath tub occupant. It will be appreciated that two gel cushions 50, each having a scrim 40, may be joined by the scrims to achieve a double thick gel configuration. Additionally, two gel cushions 50 can be bonded to a single scrim 40 to achieve a double thick gel configuration.

Figure 7:
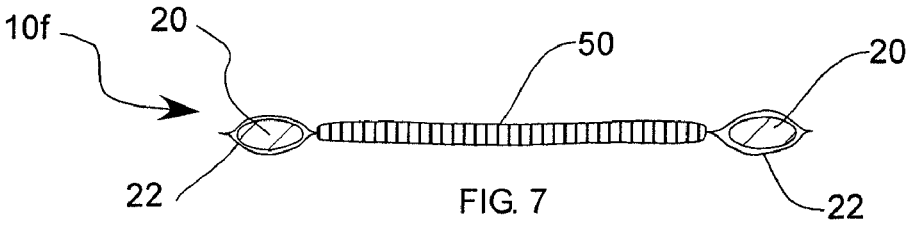
FIG. 7 is a schematic cross section view of a bathtub cushion in accordance with another embodiment of the present invention.

Referring to FIG. 7, a bathtub cushion 10*f* in accordance with another embodiment of the present invention is shown. Specifically, the gel cushion 50 is shown attached directly to the water resistant liner 22 without a scrim 40. Such a configuration can reduce the number of components for the mat.

Figure 8:
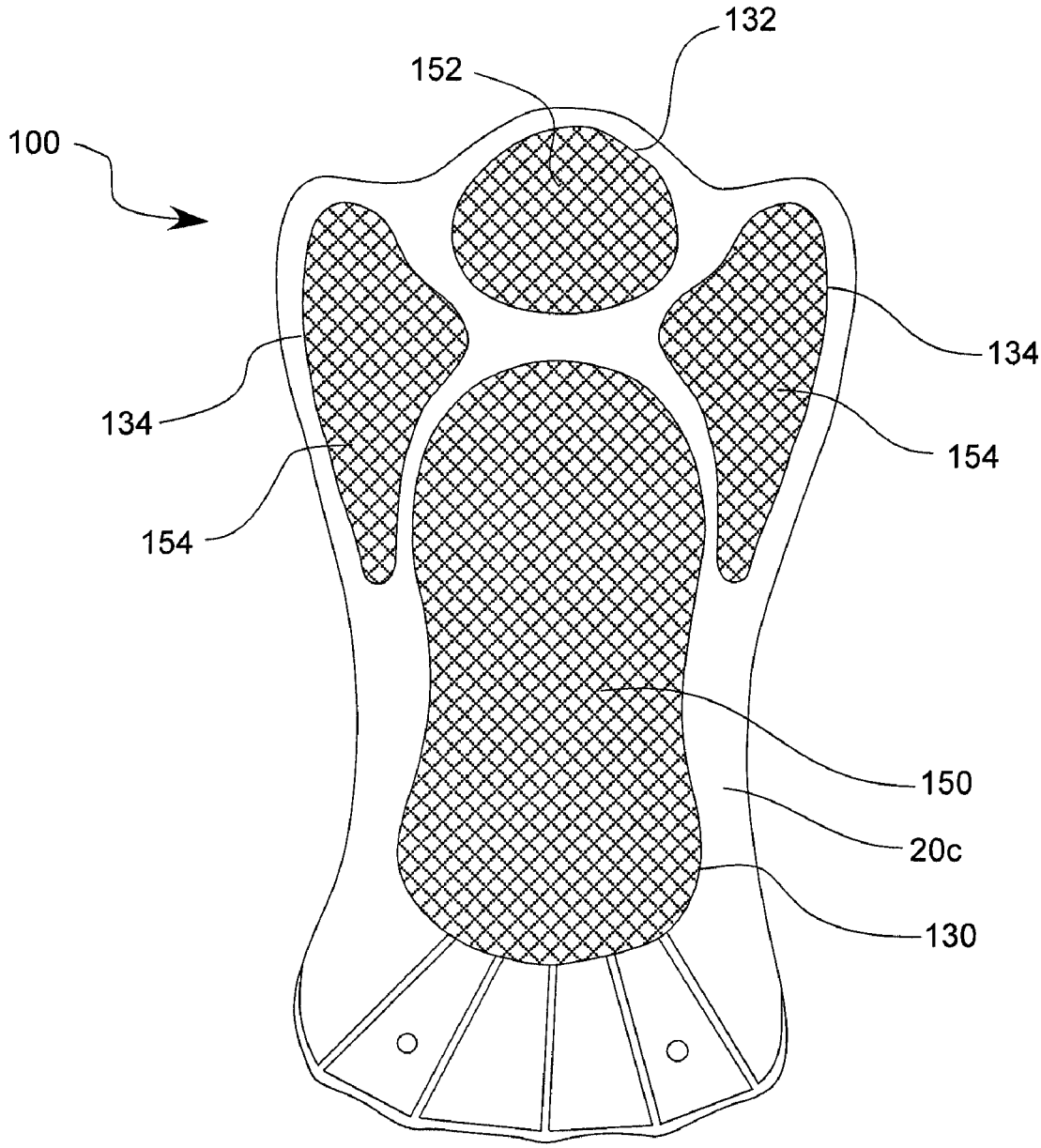
FIG. 8 is a top view of a bathtub cushion in accordance with another embodiment of the present invention.

Turning now to FIG. 8, a bathtub cushion 100 is shown in accordance with another embodiment of the present invention. Specifically, a foam mat 20*c* is shown with a plurality of recesses. The foam mat can have a torso recess 130, a head recess 132, and a pair of shoulder recesses 134. The torso recess 130 can be located near the center of the bathtub cushion 100. The head recess 132 can be located longitudinally adjacent the torso recess 130. The shoulder recesses 134 can be located laterally adjacent the torso recess 130 and head recess 134. The recesses 130, 132, and 134 can be shaped and located to correspond to the torso, head and shoulders of the bathtub occupant. Gel cushions 150, 152, and 154 can be coupled to each of the recesses 130, 132 and 134, respectively. The should recesses 134 and cushions 154 can be configured to wrap around the shoulders of a bathtub occupant in which case they would extend at least partially along the bathtub sides.

It will be appreciated that the embodiments shown in FIGS. 6 and 8 can be combined such that some of the plurality of gel cushions 150, 152, and 154 can have a double thickness, while others can only have a single thickness. For example, the torso recess 130 and head recess 132 can have gel cushions 150 and 152 with double gel thickness and the shoulder recesses 134 can have gel cushions 154 with only a single layer of gel thickness. This configuration maximizes cushioning benefit while minimizing weight of the bathtub cushion.

Having a plurality of smaller gel cushions 150, 152, and 154 reduces the weight of the bathtub cushion 100 since the gel cushion material is substantially heavier than the foam mat that frames the gel cushions. The gel cushion material is also more expensive than the foam mat material and so having a plurality of smaller gel cushions can reduce the cost of manufacturing a bathtub cushion.

The present invention also provides a method of using a bathtub cushion including disposing a bathtub cushion with an elastomeric gel having a matrix of intersecting buckling columns defining open ended cells therebetween in a bath tub. The bathtub can be filled with water such that water flows into the open ended cells of the elastomeric gel. An occupant can enter the tub and lie on the mat, thereby compressing the buckling columns of the elastomeric gel.

It will be appreciated that the tub can be filled with water after the bathtub cushion is placed in the bathtub, or the bathtub cushion can be placed in a bathtub already full of water and submerged to the bottom of the tub.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

The invention claimed is:

1. A bathtub cushion, comprising:

a mat sized and shaped to fit on a bottom of a bathtub;

a cushion coupled to and constrained by the mat;

the cushion having a matrix of intersecting buckling columns defining open ended cells therebetween;

at least one attachment device coupled to the mat to retain the mat on the bottom of the bathtub; and the mat or the cushion including at least one aperture extending therethrough.

2. A bathtub cushion in accordance with claim 1, wherein the mat includes at least one recess and wherein the cushion extends across the recess.

3. A bathtub cushion in accordance with claim 1, wherein the mat is sealed to restrict moisture from contacting the mat.

4. A bathtub cushion in accordance with claim 1, wherein the mat is sealed between at least one water resistant liner.

5. A bathtub cushion in accordance with claim 1, wherein the cushion is selected from the group consisting of an elastomeric gel, and a visco-elastic gel.

6. A bathtub cushion, comprising:

a mat sized and shaped to fit on a bottom of a bathtub;

cushion coupled to and circumscribed by the mat;

the cushion being formed of elastomeric gel;

the cushion having a matrix of intersecting buckling columns defining open ended cells therebetween;

at least one attachment device coupled to the mat to retain the mat on the bottom of the bathtub; and the mat or the cushion including apertures extending therethrough.

7. A bathtub cushion in accordance with claim 6, wherein the mat includes recesses and wherein the cushions extend across the recesses.

8. A bathtub cushion in accordance with claim 6, wherein the mat is sealed to restrict moisture from contacting the mat.

9. A bathtub cushion in accordance with claim 6, wherein the mat is sealed between at least one water resistant liner.

10. A method of using a bathtub cushion, comprising:

disposing the bathtub cushion in a bath tub, the bathtub cushion including:

a mat sized and shaped to fit on a bottom of the bath tub;

a cushion coupled to and constrained by the mat;

the cushion having a matrix of intersecting buckling columns defining open ended cells therebetween;

the mat circumscribing the cushion;

at least one attachment device coupled to the mat to retain the mat on the bottom of the bathtub; and the mat or the cushion including at least one aperture extending therethrough;

securing the bathtub cushion to a bottom and side of the bath tub with the least one attachment device;

filling the bathtub with water such that water flows through the at least one aperture; and laying on the mat.

11. A method in accordance with claim 10, wherein the mat includes at least one recess and wherein the cushion extends across the recess.

12. A method in accordance with claim 10, wherein the mat is sealed to restrict moisture from contacting the mat.

13. A method in accordance with claim 10, wherein the mat is sealed between at least one water resistant liner.

14. A method in accordance with claim 10, wherein the cushion is selected from the group consisting of an elastomeric gel, and a visco-elastic gel.

* * * * *